United States Patent [19]

Kuppinger

[11] Patent Number: 4,557,134

[45] Date of Patent: Dec. 10, 1985

[54] APPARATUS FOR SUPPORTING WORKPIECES IN A MULTISTAGE PRESS

[75] Inventor: Günter Kuppinger, Baindt, Fed. Rep. of Germany

[73] Assignee: Maschinenfabrik Müller-Weingarten AG, Weingarten, Fed. Rep. of Germany

[21] Appl. No.: 653,078

[22] Filed: Sep. 21, 1984

[30] Foreign Application Priority Data

Sep. 21, 1983 [DE] Fed. Rep. of Germany ..... 3334021

[51] Int. Cl.[4] ..... B30B 15/30; B21D 43/05

[52] U.S. Cl. ..... 72/405; 72/419; 100/207

[58] Field of Search ..... 72/405, 419; 100/207; 248/544; 269/309, 310

[56] References Cited

U.S. PATENT DOCUMENTS

| | | | |
|---|---|---|---|
| 3,707,908 | 1/1973 | Merk et al. | 100/207 |
| 4,165,667 | 8/1979 | Brolund et al. | 269/310 X |
| 4,259,052 | 3/1981 | Imanishi et al. | 72/419 X |

*Primary Examiner*—Francis S. Husar
*Assistant Examiner*—Steven B. Katz
*Attorney, Agent, or Firm*—Spencer & Frank

[57] ABSTRACT

A transfer press for a stepwise deformation of workpieces includes a plurality of stages arranged in a series and an arrangement for intermittently advancing the workpieces from one stage to a successive stage. Some of the stages are work stages for deforming the workpieces by workpiece-deforming tools and at least one of the stages is an empty stage void of tools. There is further provided a workpiece-supporting arrangement situated in the empty stage for supporting a workpiece while the workpiece dwells in the empty stage and a tool-supporting table normally situated in a work stage in a working position adjacent the empty stage and being displaceable for effecting tool replacement thereon. The workpiece-supporting arrangement has a workpiece-supporting element; a securing device for readily releasably mounting the workpiece-supporting element at least indirectly on the table for temporarily positioning the workpiece-supporting element; and a gripping and holding device installed in the empty stage for grasping the workpiece-supporting element, removing the workpiece-supporting element from the table, moving the workpiece-supporting element into a workpiece-supporting working position in the empty stage and holding the workpiece-supporting element in its working position.

4 Claims, 5 Drawing Figures

APPARATUS FOR SUPPORTING WORKPIECES IN A MULTISTAGE PRESS

BACKGROUND OF THE INVENTION

This invention relates to a workpiece supporting arrangement, for example, in the so-called empty stage of a transfer (multistage) press for large objects. The transfer press is of the type which is equipped with a transporting device, such as gripper rails, for transporting the workpieces from stage to stage and with tools disposed on and supported by displaceable tables. The empty stage in the press structure is provided with supporting elements which serve as supports for the workpieces and are adapted to their shape.

In transfer presses for large objects, in which large workpieces are processed in a number of sequential stages, empty stages are provided between the structural columns of the press since at those locations a work stage cannot be accommodated. The empty stages must be designed in such a manner that the respective workpiece, as it dwells in an empty stage between two work stages, is given a satisfactory support corresponding to its contour. This, however, means that a different support must be provided in the empty stage practically with every change of tools. In the past, such a changeover has been effected manually and has required a considerable amount of labor input.

One solution to resolve the problem of the time consuming support replacement is disclosed in U.S. patent application to Hacker et al, Ser. No. 536,035 filed Sept. 26th, 1983, now U.S. Pat. No. 4,503,766. According to the solution described therein, a plurality of point-shaped and/or small-area supporting elements are provided as depositories (workpiece positioning or supporting arrangements) in the empty stage and these depositories may be height adjustable piston rods or threaded spindles or the like to adapt their workpiece supporting end faces to the shape of the underside of the respective workpiece. While by means of this solution one and the same supporting mechanism may be set to any workpiece contour, it is relatively complex and expensive, particularly if computer control is involved.

SUMMARY OF THE INVENTION

It is an object of the invention to provide a new and improved apparatus for supporting workpieces in the empty stage of a multistage machine, such as a transfer press for large workpieces, wherein adaptation of the supporting arrangement to the contour of new workpieces is effected inexpensively and without manual intervention.

This object and others to become apparent as the specification progresses, are accomplished by the invention, according to which, briefly stated, the multistage machine has a workpiece-supporting arrangement situated in the empty stage for supporting a workpiece while the workpiece dwells in the empty stage and a tool-supporting table normally situated in a work stage in a working position adjacent the empty stage and being displaceable for effecting tool replacement thereon. The workpiece-supporting arrangement comprises a workpiece-supporting element; a securing device for readily releasably mounting the workpiece-supporting element at least indirectly on the table for temporarily positioning the workpiece-supporting element; and a gripping and holding device installed in the empty stage for grasping the workpiece-supporting element, removing the workpiece-supporting element from the table, moving the workpiece-supporting element into a workpiece-supporting working position in the empty stage and holding the workpiece-suporting element in its working position.

According to a further feature of the invention, the supporting elements are held on the tools or on the displaceable tables by means of receiving pins and magnets.

According to a further feature of the invention, receiving pins are fastened to the grippers of the gripping and holding device for cooperating with corresponding bores in the supporting elements and rotatable pins having hammer heads are provided which cooperate with slots in the supporting elements in the manner of a bayonet lock.

Each tool or displaceable table has its own associated releasable supporting element which is automatically taken by the gripping and holding device disposed in the empty stage and is moved to the supporting position. When tools are exchanged, they are automatically hung again onto the tools or the displaceable tables and are then moved out of the press areas together with the tools or with the displaceable tables.

DESCRIPTION OF THE PREFERRED EMBODIMENT

Figure 1:
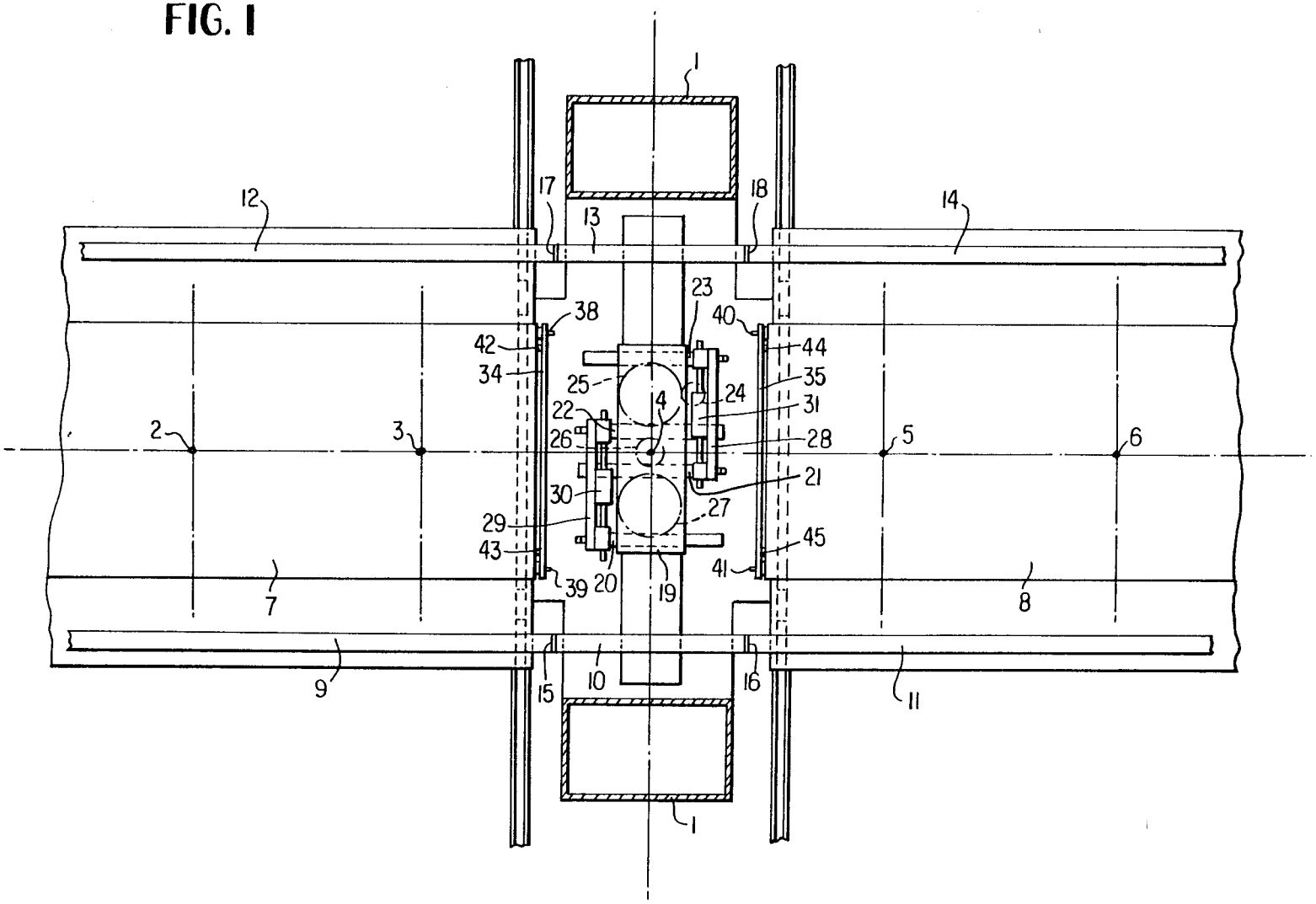
FIGS. 1, 2 and 3 are sectional top plan views along line C–D of FIG. 4 showing a preferred embodiment of the invention in different operational positions.
Figure 2:
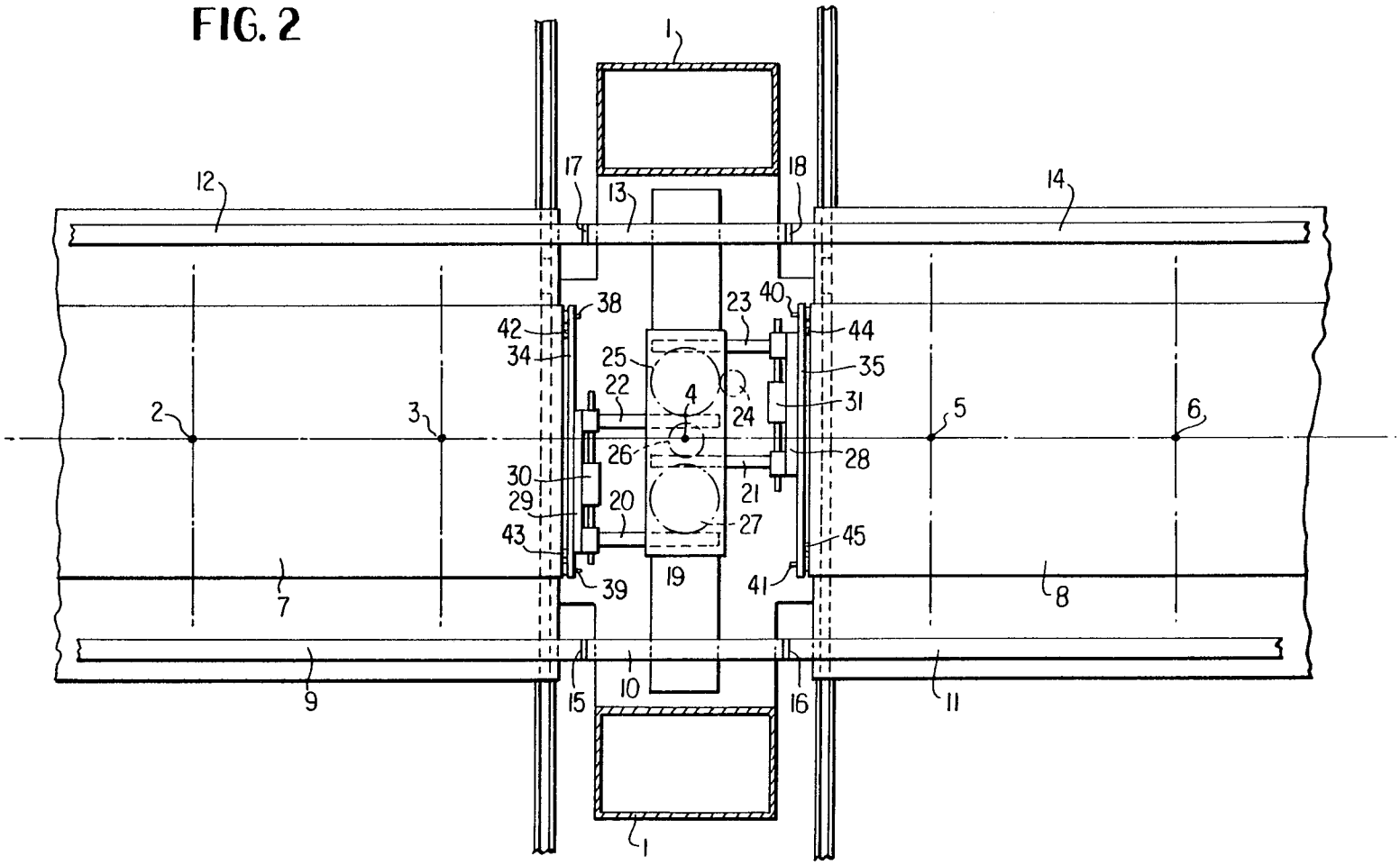
Figure 3:
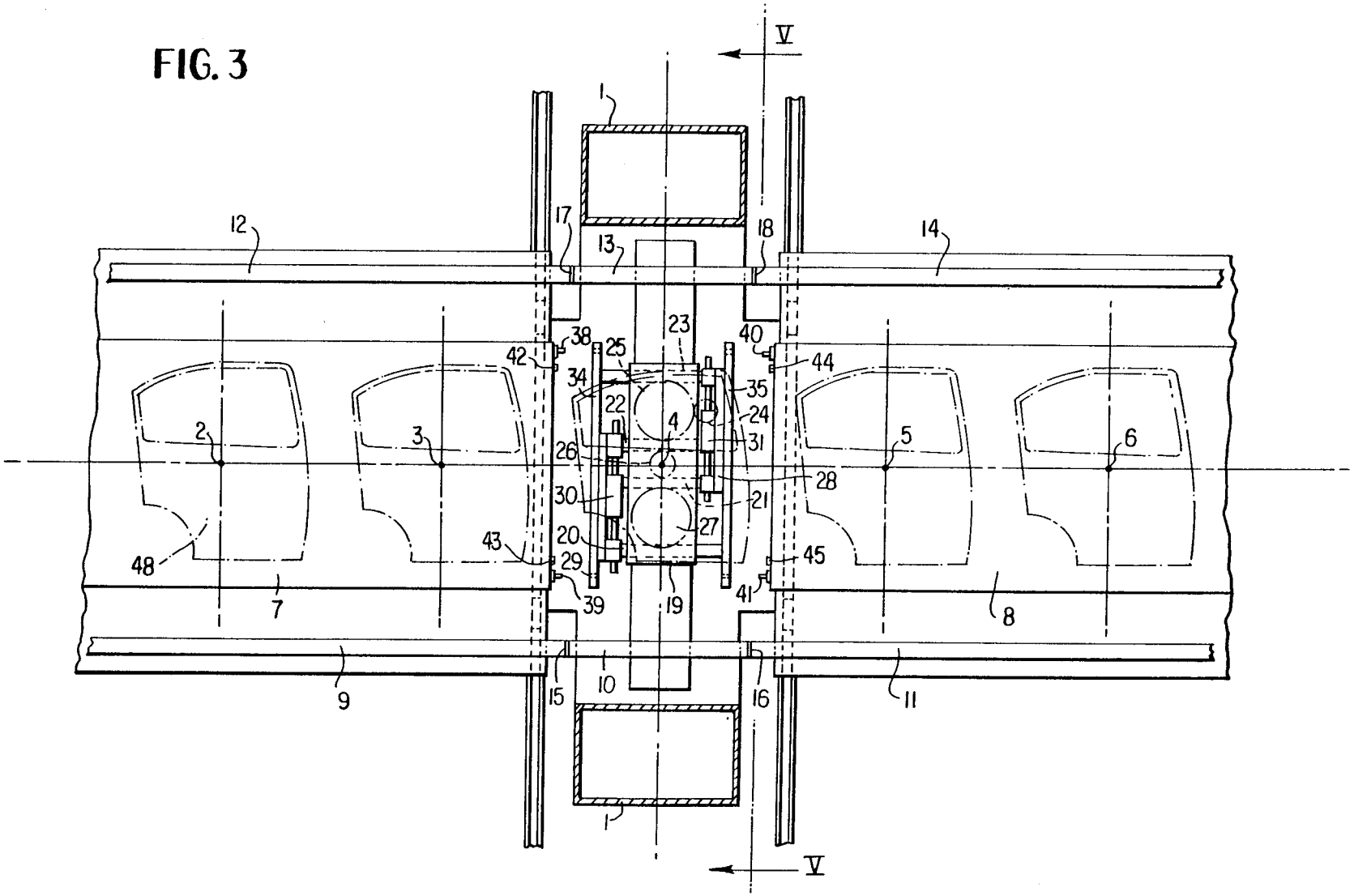
Figure 4:
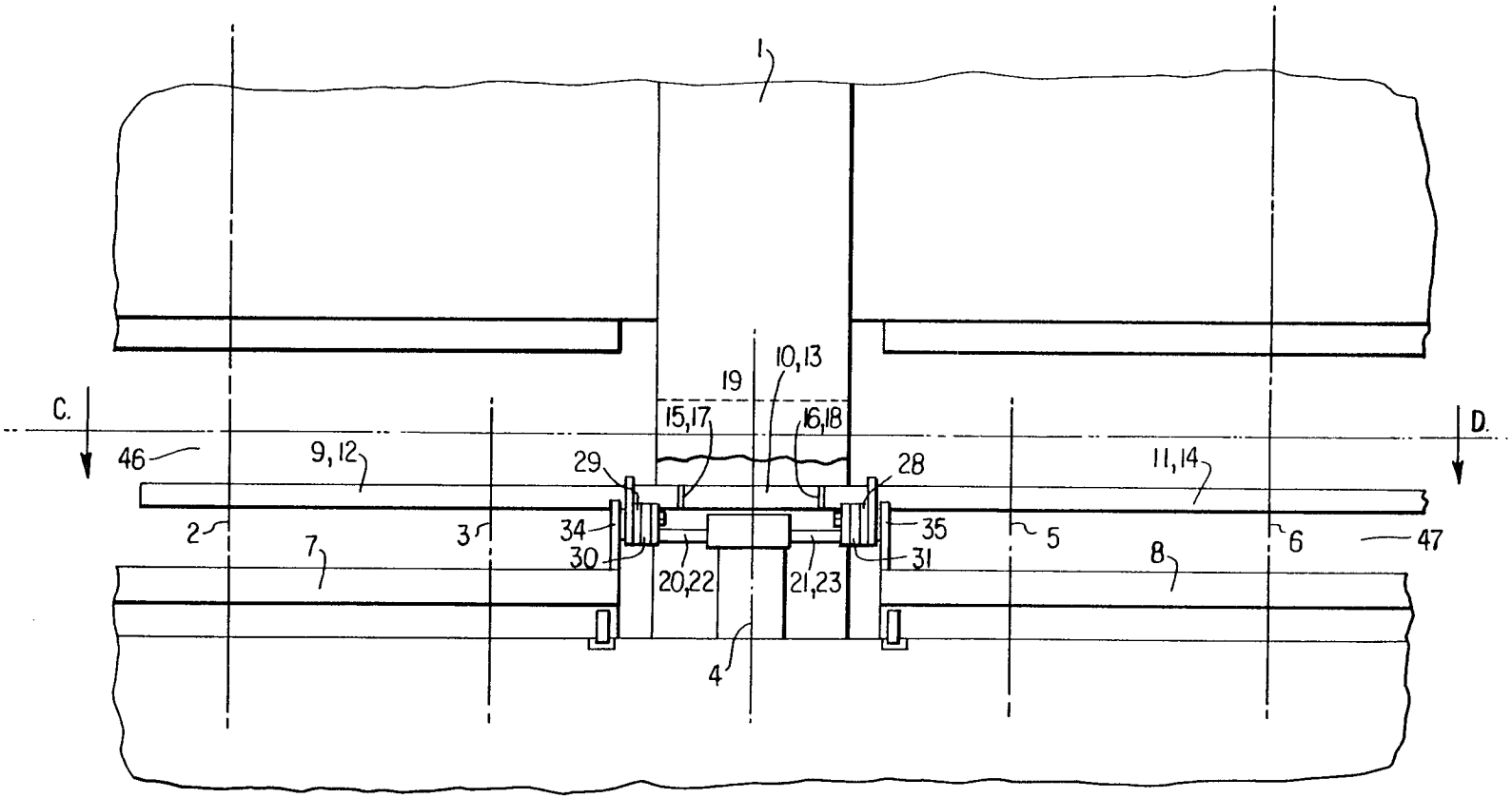
FIG. 4 is a front elevational view of the preferred embodiment with some components removed for clarity.

Turning now to FIGS. 1, 2 and 3, there are shown, of a transfer press, structural support columns 1, consecutive work stages 2, 3, 5 and 6 as well as an empty stage 4 where a workpiece is supported within a work cycle, after being worked-on in stage 3 and before being advanced to stage 5. The FIGS. 1–3 each show two tool-supporting displaceable tables 7 and 8 as well as the two gripper rails which are each composed of three parts 9, 10, 11 and 12, 13, 14, respectively. The gripper rails are part of a workpiece advancing mechanism which does not pertain to the invention and is therefore not illustrated or described. For the sake of simplicity, the rail locks provided at the abutting locations 15 through 18 are also not shown.

In the empty stage 4 there is disposed a gripping and holding device 19, essentially comprised of four grippers formed of toothed or threaded rods 20 to 23 which are driven by means of a gear drive 24 through 28 meshing with the rods 20–23.

Figure 5:
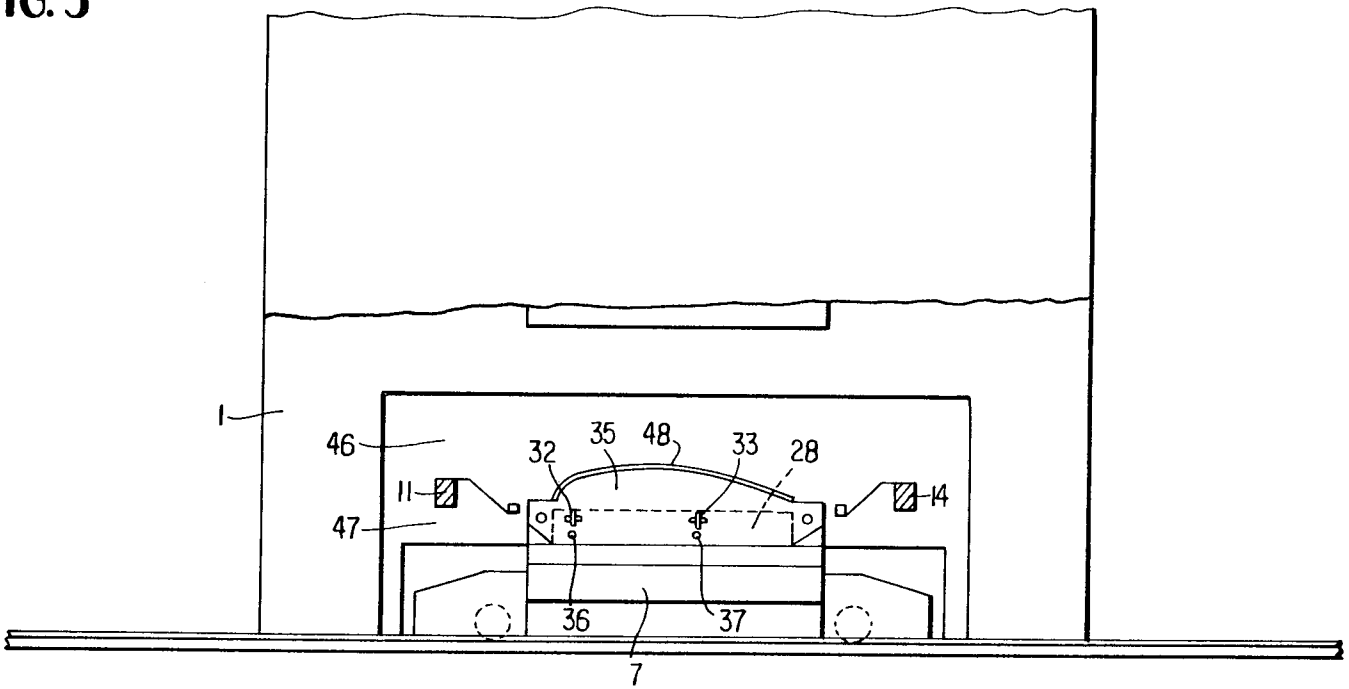
FIG. 5 is a sectional view along line V—V of FIG. 3.

The free end regions of two cooperating toothed rods 20, 22 and 21, 23 are provided with supporting plates 28 and 29, respectively, at which there are disposed drives 30 and 31 for hammer-headed pins 32 and 33, respectively, which cooperate in a bayonet-like manner with slots provided in supporting elements 34 and 35 (FIG. 5). Further, receiving pins 36 and 37 are fastened to the supporting plates 28 and 29 to cooperate with corresponding bores in supporting elements 34 and 35.

The supporting elements 34 and 35 are normally held on the tool or the displaceable tables 7 and 8 (on which the tools are mounted) by means of pins 38, 39, 40 and 41 and magnets 42 through 45 and are easily releasable.

The introduction and installation of the workpiece supporting elements 34 and 35 into empty stage 4 is effected as follows:

When, after an exchange of tools, the displaceable tables 7 and 8 have again been moved into press regions 46 and 47 (that is, they extend over work stages 2, 3, 5 and 6) they assume positions shown in FIG. 1. Thereafter, the gripping and holding device 19 is actuated, causing toothed rods 20 through 23 to move out towards the respective tables 7 and 8 and grip supporting elements 34 and 35 by means of the hammer-headed pins 32, 33, as shown in FIGS. 2 and 5.

Once the bayonet locks have engaged, the toothed rods are retracted to thus bring the supporting elements 34 and 35 into their position to serve as workpiece support in the empty stage 4. This position can be seen in FIG. 3 which also shows workpieces 48 in dot-dash lines, since in this position the press is operational.

For an exchange of tools, the above-described procedure takes place in the reverse order. The supporting elements 34, 35 are brought back into their respective holders at the displaceable tables 7 and 8 (or tools). Then the toothed rods 20–23 return to their starting positions and the supporting elements 34, 35 can be removed from the press regions together with the displaceable tables 7, 8.

It will be understood that the above description of the present invention is susceptible to various modifications, changes and adaptations, and the same are intended to be comprehended within the meaning and range of equivalents of the appended claims.

What is claimed is:

1. In a transfer press for a stepwise deformation of workpieces, including a plurality of stages arranged in a series; means extending through said stages for intermittently advancing the workpieces from one stage to a successive stage; some of said stages being work stages for deforming the workpieces by workpiece-deforming means; at least one of said stages being an empty stage void of workpiece-deforming means; workpiece-supporting means arranged in said empty stage for supporting a workpiece while the workpiece dwells in said empty stage; and a tool-supporting table normally situated in a work stage in a working position adjacent said empty stage and displaceably mounted for effecting tool replacement thereon; the improvement wherein said workpiece-supporting means comprises (a) a workpiece-supporting element;

(b) securing means readily releasably mounting said workpiece-supporting element at least indirectly on said table for temporarily positioning said workpiece-supporting element; and (c) gripping and holding means installed in said empty stage for grasping said workpiece-supporting element, removing said workpiece-supporting element from said table, moving said workpiece-supporting element into a workpiece-supporting working position in said empty stage and holding said workpiece-supporting element in its said working position.

2. A transfer press as defined in claim 1, wherein said securing means comprises pins and slots cooperating with said pins and mounted on said workpiece-supporting element and at least indirectly on said table and magnet means for holding said workpiece-supporting element against said table by magnetic attraction.

3. A transfer press as defined in claim 1, wherein said gripping and holding means comprises (a) extensible and retractable bars mounted for movement into engagement with said workpiece-supporting element held at said table and withdrawable from said table into said working position;

(b) additional securing means mounted on said bars for grasping and holding said workpiece-supporting element; and (c) means for extending and retracting said bars.

4. A transfer press as defined in claim 1, further comprising a bayonet lock for securing said workpiece-supporting element to said gripping and holding means; said bayonet lock including rotatable pins mounted on said gripping and holding means and each having a hammer-shaped head, and slots provided on said workpiece-supporting element for cooperating with said pins.

* * * * *